US006404122B1

(12) United States Patent
Lankhorst et al.

(10) Patent No.: US 6,404,122 B1
(45) Date of Patent: Jun. 11, 2002

(54) LOW-PRESSURE MERCURY VAPOR DISCHARGE LAMP

(75) Inventors: Martijn H.R. Lankhorst, Eindhoven (NL); Ulrich Niemann, Aachen (DE); Lambert C.I. Kaldenhoven, Eindhoven (NL); Wilhelmus C. Keur, Eindhoven (NL); Marinus J.W.M. Van De Ven, Eindhoven (NL)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/493,880

(22) Filed: Jan. 28, 2000

(30) Foreign Application Priority Data

Feb. 24, 1999 (EP) ..... 99200523

(51) Int. Cl.[7] ..... H01J 61/28

(52) U.S. Cl. ..... 313/490; 313/565; 313/637; 420/559

(58) Field of Search ..... 313/490, 565, 313/563, 637, 556, 562, 449, 547, 564, 550; 420/559, 577; 148/442

(56) References Cited

U.S. PATENT DOCUMENTS 4,001,626 A * 1/1977 Drop et al. ..... 313/155
4,093,889 A 6/1978 Bloem et al. ..... 313/229
4,157,485 A 6/1979 Wesselink et al. ..... 313/174
4,615,846 A * 10/1986 Yoshino et al. ..... 264/13
4,622,495 A * 11/1986 Smeelen ..... 313/490
5,204,584 A * 4/1993 Ikeda et al. ..... 313/490

FOREIGN PATENT DOCUMENTS

JP 11016536 A * 1/1999 ..... H01J/61/28
JP 2001015066 A * 1/2001 ..... H01J/61/28
JP 2001093466 A * 4/2001 ..... H01J/61/28
JP 2001243913 A * 9/2001 ..... H01J/61/28

* cited by examiner

*Primary Examiner*—Vip Patel
*Assistant Examiner*—Karabi Guharay
(74) *Attorney, Agent, or Firm*—Dicran Halajian

(57) ABSTRACT

A low-pressure mercury vapor discharge lamp is provided with a discharge vessel (10) enclosing a discharge space (11) containing a filling of mercury and a rare gas, an amalgam (63) which communicates with the discharge space (11), and means for maintaining an electric discharge in the discharge vessel (10). The amalgam (63) comprises a Bi:Sn content in the range of 80:20≦Bi:Sn≦20:80, a Pb content in the range of 0.7<Pb≦12 at % and a Hg content in the range of 0.05≦Hg≦2 at %. For compact fluorescent discharge lamps, the amalgam (63) preferably comprises 70:30≦Bi:Sn≦30:70, 1≦Pb≦10 at % and 0.25≦Hg≦1.2 at %. For electrodeless low-pressure mercury vapor discharge lamps, the amalgam preferably comprises 70:30≦Bi:Sn≦30:70, 1≦Pb≦10 at % and 0.05≦Hg≦0.5 at %. The lamp has a comparatively high initial radiation output and a short run-up time in combination with a comparatively high radiation output during nominal lamp operation, which is achieved in a comparatively large temperature interval.

5 Claims, 5 Drawing Sheets

LOW-PRESSURE MERCURY VAPOR DISCHARGE LAMP

BACKGROUND OF THE INVENTION

The invention relates to a low-pressure mercury vapor discharge lamp provided with a discharge vessel, which discharge vessel encloses a discharge space containing a filling of mercury and a rare gas in a gastight manner, which discharge vessel contains an amalgam which is in communication with the discharge space, and in which the low-pressure mercury vapor discharge lamp comprises discharge means for maintaining an electric discharge in the discharge vessel.

In mercury vapor discharge lamps, mercury constitutes the primary component for (efficiently) generating ultraviolet (UV) light. A luminescent layer comprising a luminescent material (for example, a fluorescence powder) may be present on an inner wall of the discharge vessel for converting UV to other wavelengths, for example to UV-B and UV-A for tanning purposes (sun panel lamps) or to visible radiation for general purposes of illumination. Such discharge lamps are therefore also referred to as fluorescence lamps. The discharge vessel of low-pressure mercury vapor discharge lamps is usually circular and comprises both elongated and compact embodiments. Generally, the tubular discharge vessel of compact fluorescence lamps has a collection of comparatively short straight parts of a comparatively small diameter, which straight parts are interconnected by means of bridge parts or via bent parts. Compact fluorescence lamps are usually provided with an (integrated) lamp base. In such embodiments of the low-pressure mercury vapor discharge lamp, the discharge means comprise electrodes which are arranged in the discharge space. An alternative embodiment comprises the electrodeless low-pressure mercury vapor discharge lamps.

The term "nominal operation" in the description and claims of the present invention is used for indicating operating conditions in which the mercury vapor pressure is such that the radiation output of the lamp is at least 80% of the output during optimum operation, i.e. under operating conditions where the mercury vapor pressure is optimal. The amalgam limits the mercury vapor pressure in the discharge vessel as compared with the discharge lamp containing only free mercury. This renders nominal operation of the lamp possible at comparatively high lamp temperatures such as may occur in the case of a high lamp load, or when the lamp is used in a closed or badly ventilated luminaire. Furthermore, the term "initial radiation output" in the description and claims is defined as the radiation output of the discharge lamp 1 second after switching on the discharge lamp and the "run-up time" as the time which the discharge lamp requires for achieving a radiation output of 80% of that during optimum operation.

A low-pressure mercury vapor discharge lamp as described in the opening paragraph, hereinafter also referred to as vapor pressure-controlled lamp, is known from U.S. Pat. No. 4,093,889. The mercury vapor pressure at room temperature is comparatively low in the known lamp. The known lamp thus has the drawback that, when it is operated on a conventional lamp supply, the initial radiation output is also comparatively low. Moreover, the run-up time is comparatively long because the mercury vapor pressure rises only slowly after switching on the lamp.

In addition to the amalgam lamps described above, low-pressure mercury vapor discharge lamps are known which do not only comprise a (main) amalgam but also an auxiliary amalgam. Provided that the auxiliary amalgam contains sufficient mercury, the lamp will have a comparatively short run-up time. Upon switching on the lamp, the auxiliary amalgam is heated by the electrode so that it evolves a substantial portion of the mercury present therein comparatively quickly. It is desirable that the lamp must have been out of operation for a sufficiently long time before switching on, so that the auxiliary amalgam has been able to take up sufficient mercury. If the lamp has been out of operation for a comparatively short period, the shortening effect on the run-up time is only weak. In addition, the initial radiation output is (even) lower than that of a lamp with a main amalgam only because the auxiliary amalgam sets a comparatively lower mercury vapor pressure in the discharge space. Furthermore, the drawback arises in comparatively long lamps that comparatively much time is required before the mercury evolved by the auxiliary amalgam has spread over the entire discharge vessel, so that such lamps show a comparatively bright zone near the auxiliary amalgam and a comparatively dark zone remote from the auxiliary amalgam for a few minutes after switching on.

Furthermore, low-pressure mercury vapor discharge lamps are known which are not provided with amalgam and contain exclusively free mercury. These lamps, hereinafter also referred to as mercury lamps, have the advantage that the mercury vapor pressure at room temperature and hence the initial radiation output are comparatively high. Moreover, the run-up time is comparatively short. Also comparatively long lamps of this type have an approximately constant brightness substantially throughout the length after switching on, because the vapor pressure (at room temperature) is sufficiently high upon switching on. Nominal operation at comparatively high lamp temperatures can be achieved with a mercury lamp whose discharge space contains (just) enough mercury to establish a mercury vapor pressure at the operating temperature, which mercury vapor pressure is close to the optimum mercury vapor pressure. During the lifetime of the lamp, however, mercury is lost because this is bound, for example, on a wall of the discharge vessel and/or on emitter material. In practice, such a lamp thus has only a limited lifetime. In mercury lamps, a quantity of mercury is therefore dosed which is considerably higher than the quantity required in the vapor phase during nominal operation. However, this has the drawback that the mercury vapor pressure is equal to the vapor saturation pressure associated with the temperature of the coldest spot in the discharge vessel. Since the vapor saturation pressure rises exponentially with the temperature, temperature variations which occur, for example, in a badly ventilated luminaire or in the case of a high lamp load, lead to a decrease of the radiation output. At comparatively low ambient temperatures, the mercury vapor pressure decreases, which also leads to a decrease of the radiation output.

SUMMARY OF THE INVENTION

It is an object of the invention to provide a lamp low pressure mercury vapor discharge which, at least in regular use, has a comparatively high initial radiation output and a comparatively short run-up time, and also a comparatively high radiation output in a comparatively large range of ambient temperatures.

According to the invention, the amalgam has a bismuth-tin ratio (Bi:Sn) in the range of $20:80 \leqq Bi:Sn \leqq 80:20$, a lead content (Pb) in the range of $0.7 \leqq Pb \leqq 12$ at % and a mercury content (Hg) in the range of $0.05 \leqq Hg \leqq 2$ at %.

An advantage of the use of such an amalgam is that, at room temperature, the mercury vapor pressure is comparatively close to that of liquid mercury. With said composition of the amalgam, the discharge lamp is nominally operated at a corresponding temperature of the coldest spot in the discharge vessel, ranging between comparatively wide temperatures of 65° C. to 140° C. A further advantage of the use of such an amalgam is that the curves at which the mercury vapor pressure is plotted as a function of the temperature can be adjusted via the mercury content and/or the composition of the amalgam. Said properties of the (main) amalgam, namely the broad temperature interval and the variable mercury vapor pressure curves are realized by the choice of the composition of the amalgam according to the invention. For the amalgams with a composition according to the invention, curves in which the mercury vapor pressure is plotted as a function of the temperature have a first stabilization range in the temperature range under the ternary Bi—Sn—Pb eutectic (at 100° C.). In said stabilization range, these curves are at least substantially independent of the mercury content and the composition of the amalgam. The latter property is mainly caused by the fact that the number of phases in the corresponding temperature interval is equal to the number of components, which results in the mercury vapor pressure being mainly only a function of the temperature. In the description of the present invention, the term "stabilization range" is understood to mean a temperature range within which the mercury pressure ($P_{Hg}$) is at least substantially constant.

The mercury vapor pressure versus temperature curves of the amalgam with a composition according to the invention comprise a second stabilization range which is present in the temperature range above the ternary Bi—Sn—Pb eutectic and below the binary Bi—Sn eutectic. Since the number of phases is smaller than the number of components in said second stabilization range (above the eutectic point), the mercury vapor pressure is a function of both the temperature and of the composition of the amalgam, particularly of the mercury content and the lead content of the amalgam. The result is that low-pressure mercury vapor discharge lamps provided with an amalgam having a composition in accordance with the invention combine a satisfactory initial radiation output and a comparatively short run-up time with a comparatively broad interval, at nominal operation, for the temperature of the coldest spot in the discharge vessel. Nominal lamp operation is thus possible in a comparatively large temperature interval.

A further advantage of the use of the amalgam according to the invention is that the amalgam is usable in low-pressure mercury vapor discharge lamps that can be dimmed.

An embodiment of the low-pressure mercury vapor discharge lamp in accordance with a first aspect of the invention is characterized in that, in the amalgam, the bismuth-tin ratio is $20:80 \leqq Bi:Sn \leqq 80:20$, the lead content is $0.7 \leqq Pb \leqq 12$ at % and the mercury content is $0.2 \leqq Hg \leqq 2$ at %.

With this composition of the amalgam, at least 80% of the radiation output (nominal operation) of the low-pressure mercury vapor discharge lamp is achieved, in operation, at a corresponding temperature of the coldest spot in the discharge vessel, within a comparatively wide temperature range of 65° C. to 140° C., while at least 90% of the radiation output is achieved at a corresponding temperature of the coldest spot, within a comparatively wide temperature range of 70° C. to 130° C. The run-up time of the discharge lamp with an amalgam in accordance with a first aspect of the invention is less than ten minutes in both cases, and in the presence of an auxiliary amalgam, the run-up time decreases to less than three minutes. Amalgams having a composition in accordance with a first aspect of the invention are notably suitable for use in (energy-saving) (compact) low-pressure mercury vapor discharge lamps. Such discharge lamps have a satisfactory initial radiation output and combine a comparatively short run-up time with a comparatively broad interval for the temperature of the coldest spot in the discharge vessel during nominal operation. Consequently, nominal lamp operation is possible within a comparatively large temperature interval.

In a preferred embodiment of the low-pressure mercury vapor discharge lamp in accordance with a first aspect of the invention, the bismuth-tin ratio in the amalgam is $30:70 \leqq Bi:Sn \leqq 70:30$, the lead content is $1 \leqq Pb \leqq 10$ at % and the mercury content is $0.25 \leqq Hg \leqq 1.2$ at %.

With this composition of the amalgam, at least 80% of the radiation output (nominal operation) of the low-pressure mercury vapor discharge lamp is achieved, in operation, at a corresponding temperature of the coldest spot of the discharge vessel within a comparatively wide temperature range of 70° C. to 170° C., while at least 90% of the radiation output is achieved at a corresponding temperature of the coldest spot within a comparatively wide temperature range of 75° C. to 160° C. The run-up time of the discharge lamp is less than ten minutes in both cases, and in the presence of an auxiliary amalgam, the run-up time decreases to less than three minutes. The result is that (energy-saving) (compact) low-pressure mercury vapor discharge lamps provided with an amalgam in accordance with a first aspect of the invention combine a satisfactory initial radiation output and a comparatively short run-up time with a comparatively very wide interval, during nominal operation, for the temperature of the coldest spot in the discharge vessel. Nominal lamp operation is thus possible within a comparatively very large temperature interval. For a suitably chosen Hg content (for example, 0.5 at % Hg), the temperature of the coldest spot during nominal operation of the discharge lamp may be as high as 180° C.

In accordance with a second aspect of the invention, a low-pressure mercury vapor discharge lamp of the type described in the opening paragraph is therefore characterized in that the bismuth-tin ratio in the amalgam is $20:80 \leqq Bi:Sn \leqq 80:20$, the lead content is $0.7 \leqq Pb \leqq 12$ at % and the mercury content is $0.05 \leqq Hg \leqq 0.5$ at %.

With this composition of the amalgam, at least 80% of the radiation output (nominal operation) of the low-pressure mercury vapor discharge lamp is achieved, in operation, at a corresponding temperature of the coldest spot in the discharge vessel within a comparatively wide temperature range of 65° C. to 140° C. Amalgams in accordance with a second aspect of the invention are notably suitable for use in electrodeless lamps.

In a preferred embodiment of the low-pressure mercury vapor discharge lamp in accordance with a second aspect of the invention, the bismuth-tin ratio in the amalgam is $30:70 \leqq Bi:Sn \leqq 70:30$, the lead content is $1 \leqq Pb \leqq 10$ at % and the mercury content is $0.05 \leqq Hg \leqq 0.5$ at %.

With said composition of the amalgam, at least 80% of the radiation output (nominal operation) of the low-pressure mercury vapor discharge lamp is achieved, in operation, at a corresponding temperature of the coldest spot of the discharge vessel within a comparatively wide temperature range of 70° C. to 170° C.

In addition to said materials, the amalgam according to the invention may also comprise additions of, for example, zinc, silver, gallium, indium and/or other elements. It is desirable that such additions shift the melting range (100° C. to 140° C.) of the Bi—Sn—Pb alloys by not more than 20° C.

At the start of the lifetime of a low-pressure mercury vapor discharge lamp, a comparatively large quantity of mercury may be bound on the wall during operation. To avoid this, the discharge vessel of a lamp according to the invention may have a protective coating of a metal oxide on an internal surface. Such a protective coating, for example, of scandium oxide, yttrium oxide, lanthanum oxide or of an oxide of one of the lanthanides inhibits loss of mercury through binding on the wall. It is favorable when the discharge lamp consumes a small amount of mercury so that the amalgam can be designed in a more optimum way.

These and other aspects of the invention are apparent and will be elucidated with reference to the embodiments described hereinafter.

BRIEF DESCRIPTION OF THE DRAWINGS

The Figures are purely schematic and not to scale. For the sake of clarity, some dimensions are strongly exaggerated. Similar components in the Figures are denoted by the same reference numerals as much as possible.

DETAILED DESCRIPTION OF THE PREFERRED EMBODIMENTS

Figure 1A:
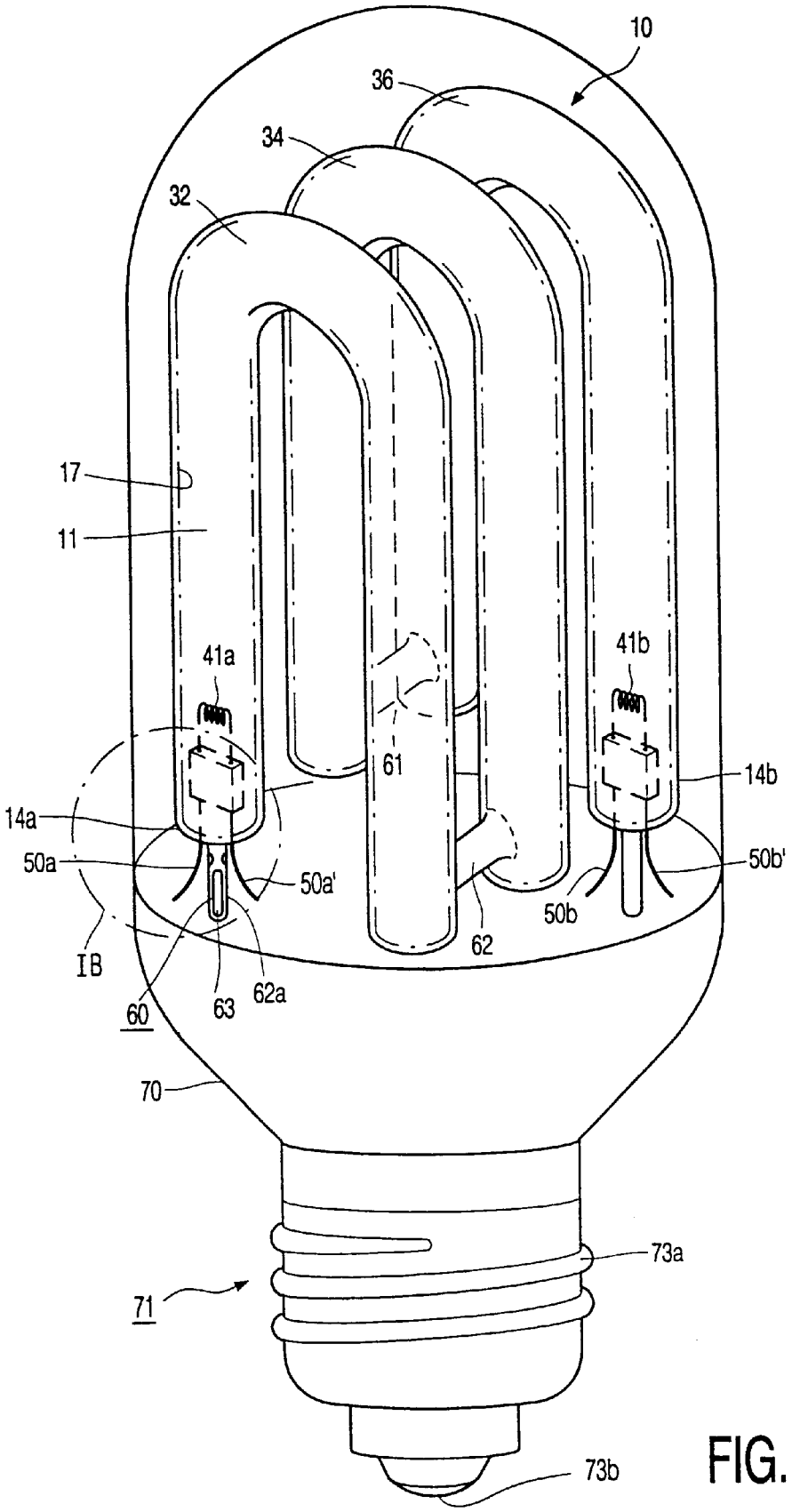
FIG. 1A is a perspective view of an embodiment of the low-pressure mercury vapor discharge lamp comprising an amalgam in accordance with a first aspect of the invention.
Figure 1B:
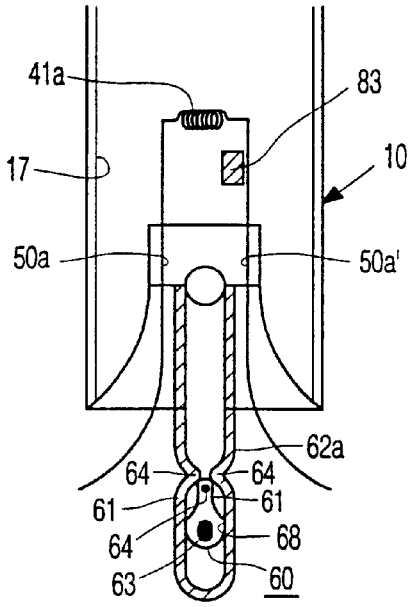
FIG. 1B shows a detail of the lamp of FIG. 1A in accordance with IB in a side-elevational view.

FIG. 1A is a perspective elevational view of an embodiment of the low-pressure mercury vapor discharge lamp, comprising a radiation-transmissive discharge vessel 10 which encloses a discharge space 11 having a volume of approximately 30 $cm^3$ in a gastight manner. In this case, the discharge vessel 10 comprises a mixture of 75% by volume of argon and 25% by volume of neon with a filling pressure of 400 Pa. In this embodiment, the discharge vessel 10 is formed from a light-transmissive tubular portion of lime glass having three U-shaped segments 32, 34, 36 with a diameter of 11 mm and an overall length of approximately 46 cm and an internal diameter of approximately 10 mm, which is sealed by end portions 14A; 14B. The segments 32, 34, 36 are interconnected by (tubular) ducts 61, 62. The tubular portion has a luminescent coating 17 on an internal surface. Means for maintaining a discharge are constituted by an electrode pair 41*a;* 41*b* arranged in the discharge space 11 in the embodiment of FIG. 1A. The electrode pair 41*a*; 41*b* is a winding of tungsten coated with an electron-emissive material (emitter material), in this case a mixture of barium, calcium and strontium oxide. Each electrode 41*a*; 41*b* is supported by an (indented) end portion 14*a*; 14*b* of he discharge vessel 10. Current supply conductors 50*a*, 50*a* '; 50*b*, 50*b*' project from the electrode pair 41*a*; 41*b* through the end portions 14*a*; 14*b* of the discharge vessel 10. The current supply conductors 50*a*, 50*a* '; 50*b*, 50*b*' are connected to a power supply (not shown) incorporated in the housing 70 and electrically connected to known electrical and mechanical contacts 73*a*, 73*b* on the lamp base 71. The discharge space 11 comprises, in addition to mercury, a rare gas, namely argon and neon in this embodiment. In this embodiment, mercury is not only present in the discharge space 11 but also in an amalgam 63 in accordance with a first aspect of the invention (see also FIG. 1B in which a detail of the lamp of FIG. 1A in accordance with IB is shown in a side-elevational view). To this end, a capsule 60 with a wall 61 of a lime glass comprising 4.0% by weight of FeO is arranged in the discharge vessel 10, in this case in a tubular protuberance 62*a*. In operation, the amalgam 63 is in communication with the discharge vessel 10. An aperture 64 is melted in the wall 61 of the capsule 60. The capsule 60 has a domed portion 68 with which it is clamped into the protuberance 62*a*. The capsule 60 comprises an amalgam 63 in accordance with a first aspect of the invention, here 100 mg of an amalgam of Hg with an alloy of bismuth, tin and lead. A particularly suitable composition of the amalgam 63 in accordance with a first aspect of the invention comprises 44 at % of Bi, 52 at % of Sn, 4 at % of Pb and 0.5 at % of Hg (apart from additions or impurities), denoted by Bi44—Sn52—Pb4—Hg0.5. In the embodiment of FIG. 1B, one of the current supply conductors 50*a*' is further provided with a flag supporting an auxiliary amalgam 83. When the low-pressure mercury vapor discharge lamp is switched on, the auxiliary amalgam 83 is heated by the electrode 41*a* so that it evolves a substantial part of the mercury therein at a comparatively fast rate. In an alternative embodiment of the low-pressure mercury vapor discharge lamp described above, the amalgam is dosed without a capsule, using a glass rod to prevent the amalgam from reaching the discharge vessel.

Figure 2:
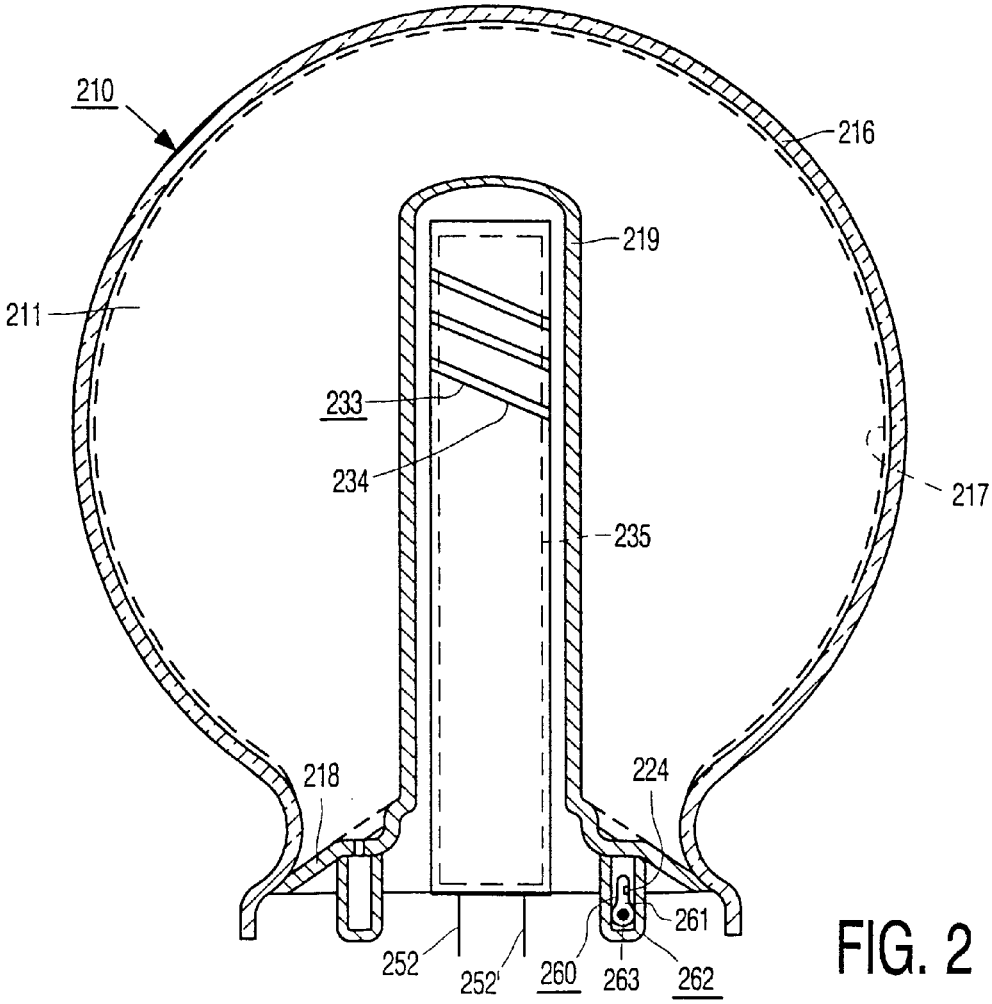
FIG. 2 shows an embodiment of the low-pressure mercury vapor discharge lamp comprising an amalgam in accordance with a second aspect of the invention.

In FIG. 2, components corresponding to those in FIG. 1A have a reference numeral raised by 200. In the embodiment of the low-pressure mercury vapor discharge lamp, shown in FIG. 2, with an amalgam in accordance with a second aspect of the invention, the discharge vessel 210 has a pear-shaped enveloping portion 216 and a tubular invaginated portion 219 which is connected to the enveloping portion 216 via a flared portion 218. A capsule 260 comprising an amalgam 263 in accordance with a second aspect of the invention is formed in a protuberance 262 on the flared portion 218 of the discharge vessel 210. The invaginated portion 219, outside a discharge space 211 surrounded by the discharge vessel 210, accommodates a coil 233 which has a winding 234 of an electric conductor constituting means for maintaining an electric discharge in the discharge space 211. The coil 233 is fed via current supply conductors 252, 252' with a high-frequency voltage during operation, i.e. a frequency of more than about 20 kHz, for example approximately 3 MHz. The coil 233 surrounds a core 235 of a soft-magnetic material (shown in broken lines). Alternatively, a core may be absent. In an alternative embodiment, the coil is arranged, for example, in the discharge space 211.

Figure 3:
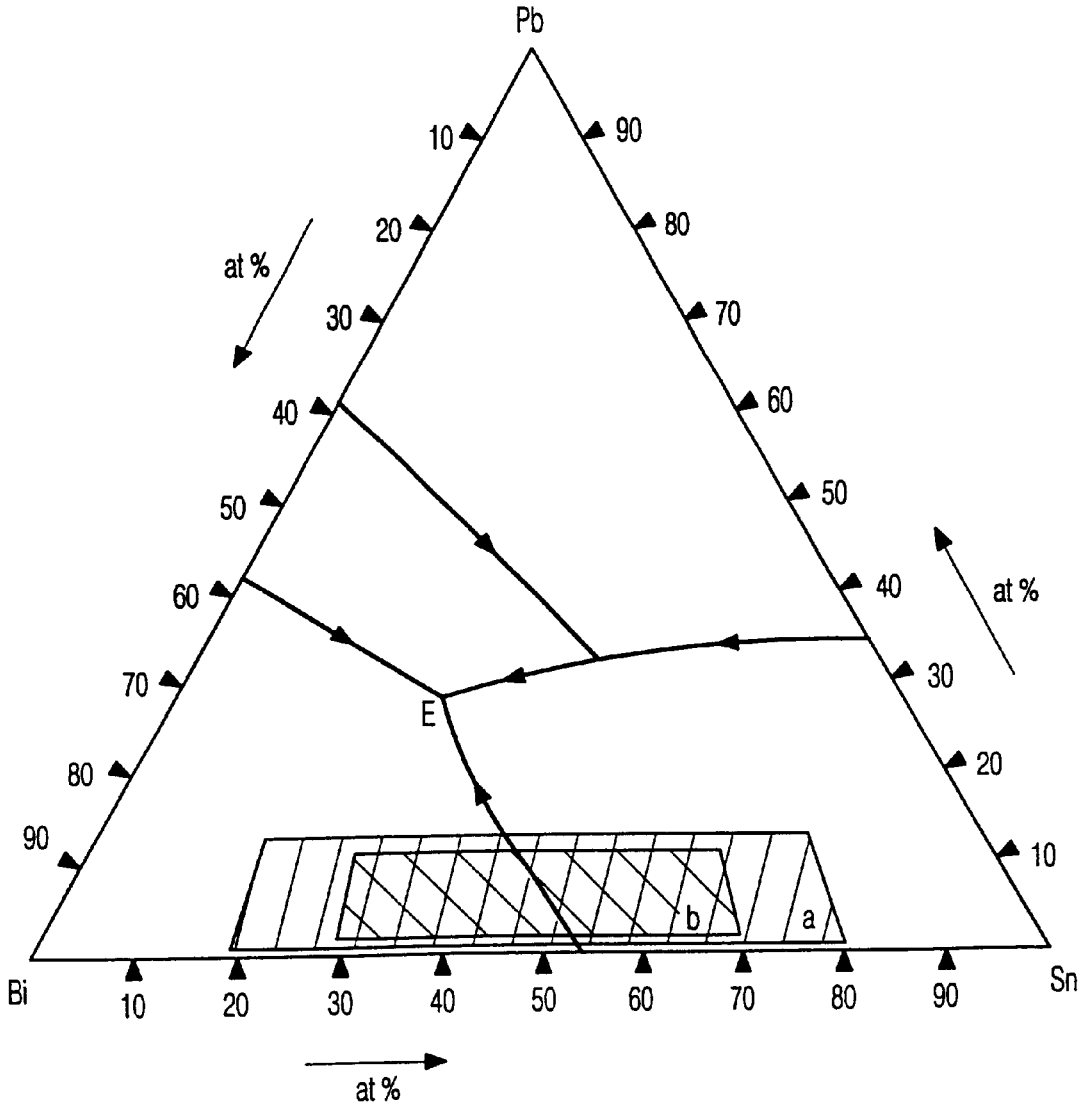
FIG. 3 shows the ternary phase diagram of Bi—Sn—Pb including the ranges of composition of the amalgam according to the invention.

FIG. 3 shows a ternary phase diagram of Bi—Sn—Pb including the ranges of composition of the amalgam 63 according to the invention, in which the desired effect is realized when 0.2-2 at % of Hg in accordance with a first aspect of the invention or 0.05-0.5 at % Hg in accordance with a second aspect of the invention is added to the desired compositions. Range (a) in FIG. 3 shows the range in which the amalgam has a bismuth-tin ratio (Bi:Sn) in the range between 20:80≦Bi:Sn≦80:20 and a lead content (Pb) in the range between 0.7≦Pb≦12 at %. Range (b) in FIG. 3 shows the range in which the amalgam has a bismuth-tin ratio of 30:70≦Bi:Sn≦70:30 and a lead content of 1≦Pb≦10 at %.

Figure 4A:
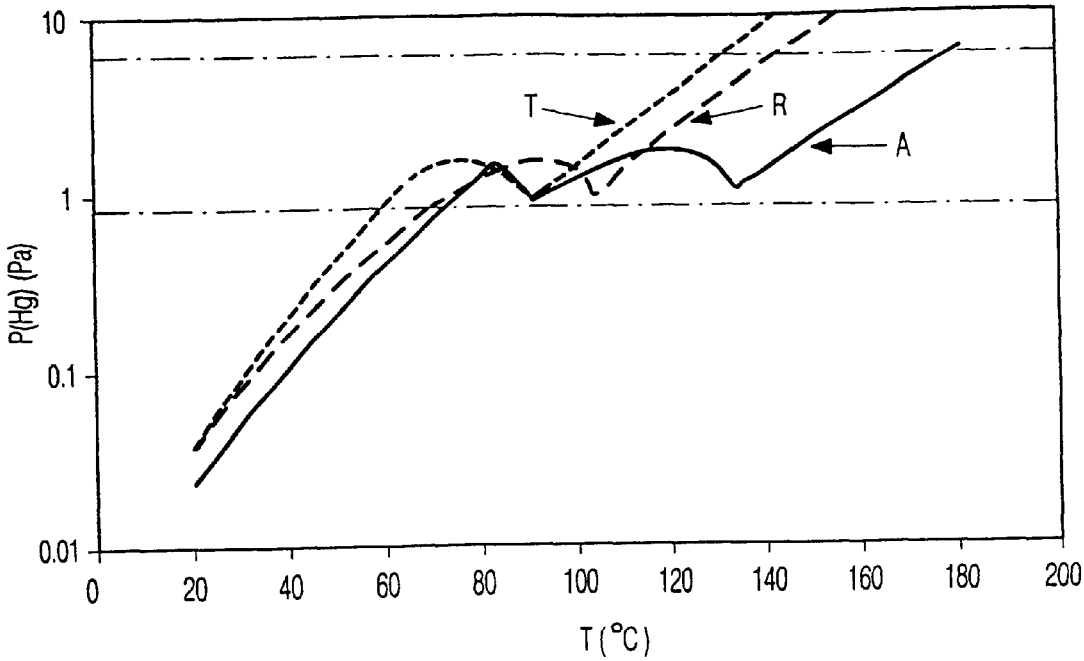
FIG. 4A shows a graph in which the mercury vapor pressure as a function of the temperature for an amalgam in accordance with a first aspect of the invention is compared with mercury vapor pressure curves of two known amalgams.

FIG. 4A shows a graph in which the mercury vapor pressure ($P_{Hg}$ expressed in Pa) as a function of the temperature (in degrees Celsius) of particularly suitable amalgam Bi44—Sn52—Pb4—Hg0.5 (curve A) in accordance with a first aspect of the invention is compared with corresponding mercury vapor pressure curves of two known amalgams, namely those of Bi53—Sn47—Hg3 (curve R, amalgam known from U.S. Pat. No. 4,157,485) and of Bi48—Sn24—Pb28—Hg3 (curve T, amalgam known from U.S. Pat. No. 4,093,889). The two horizontal dot-and-dash lines show the range within which the radiation output is at least 80% of that during optimal operation. A comparison of the mercury vapor pressure curves in FIG. 4A shows that the amalgam in accordance with a first aspect of the invention has a wider stabilization range and that such amalgams can be used in lamps with a higher coldest spot temperature. Amalgams in accordance with a first aspect of the invention are notably suitable for use in (compact) fluorescence lamps.

Figure 4B:
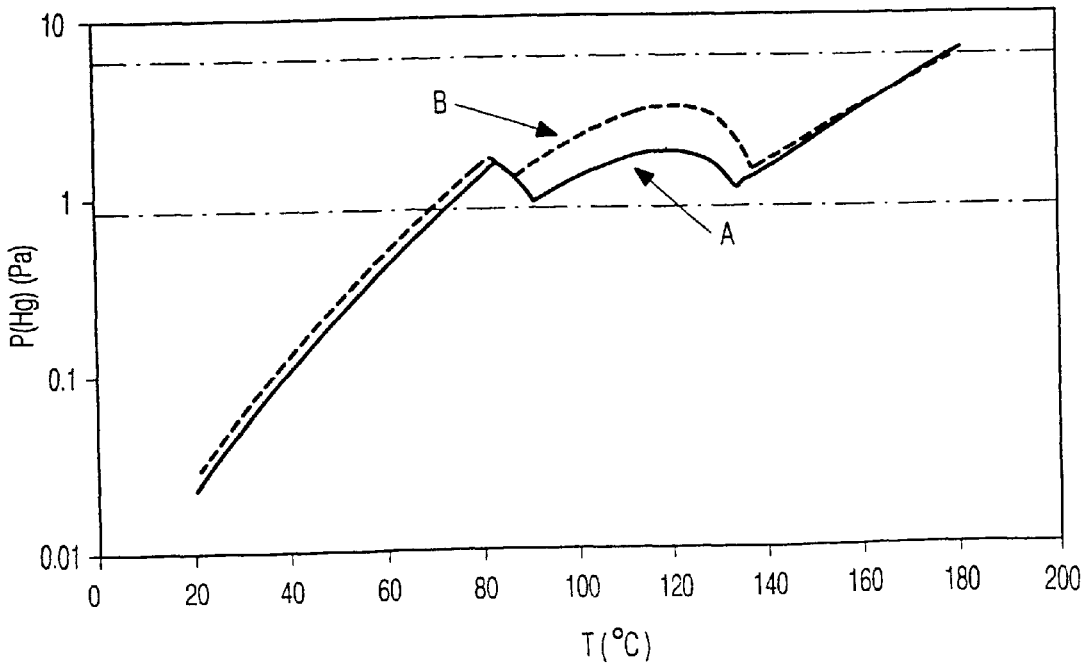
FIG. 4B shows a graph in which the mercury vapor pressure as a function of the temperature is plotted for an amalgam in accordance with a first aspect of the invention, comprising different lead contents.

FIG. 4B shows a graph in which the mercury vapor pressure $P_{Hg}$ is plotted as a function of the temperature for two compositions of the amalgam in accordance with a first aspect of the invention, namely Bi44—Sn52—Pb4 (curve A) and Bi45—Sn53—Pb2 (curve B), to which 0.5 at % of Hg is added in both cases. The two horizontal dot-and-dash lines show the range within which the radiation output is at least 80% of that during optimal operation. FIG. 4B shows how the mercury vapor pressure curves in the temperature range between the ternary Bi—Sn—Pb eutectic (denoted by E in FIG. 3) and the binary Bi—Sn eutectic may be influenced by the lead content.

Figure 4C:
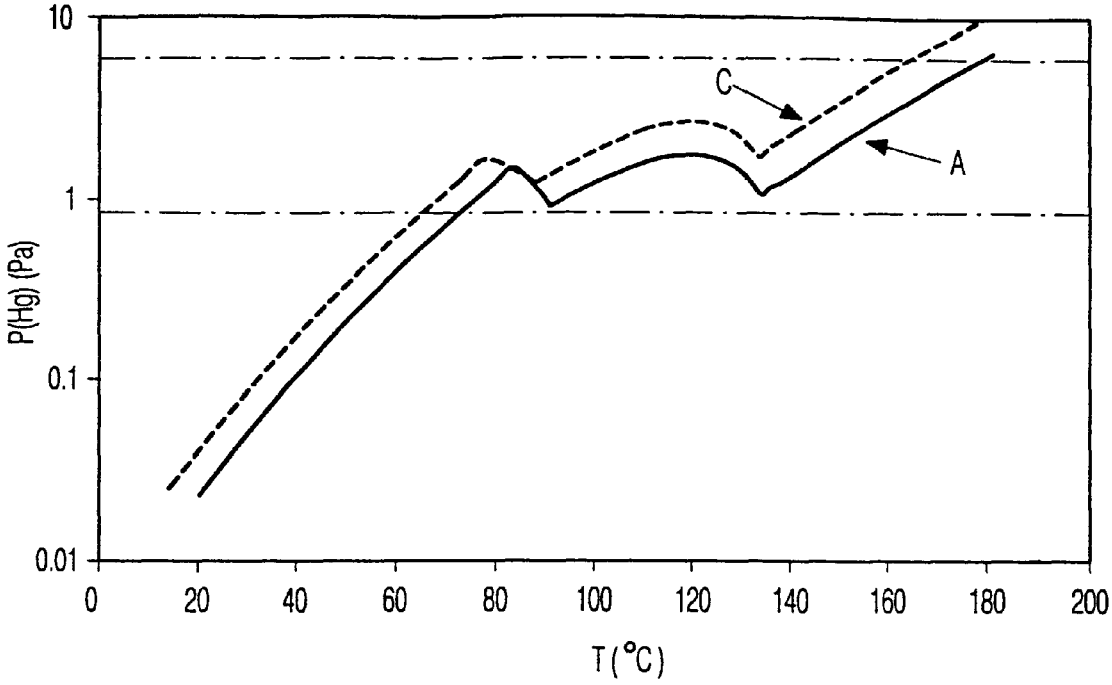
FIG. 4C shows a graph in which the mercury vapor pressure is plotted as a function of the temperature for an amalgam in accordance with a first aspect of the invention, comprising different mercury contents.

FIG. 4C shows a graph in which the mercury vapor pressure $P_{Hg}$ is plotted as a function of the temperature for two compositions of the amalgam in accordance with a first aspect of the invention, namely Bi44—Sn52—Pb4—Hg—0.5 (curve A) and Bi44—Sn52—Pb4—Hg0.8 (curve C). The two horizontal dot-and-dash lines show the range within which the radiation output is at least 80% of that during optimal operation. FIG. 4C shows how the mercury vapor pressure curves can be optimized with the mercury content. For low-pressure mercury vapor discharge lamps which consume a comparatively small quantity of mercury during their lifetime, a more optimal amalgam may be designed which comprises a comparatively low initial mercury content, which is favorable for a high radiation output within a comparatively wide range of ambient temperatures during the lifetime of the discharge lamp.

Figure 5:
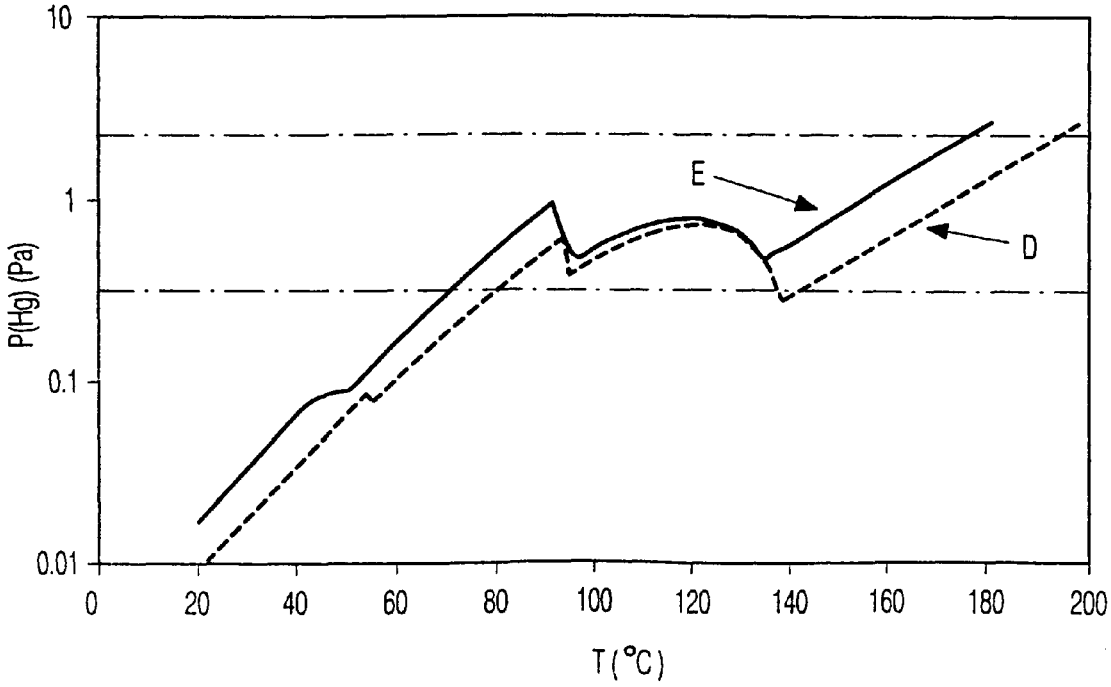
FIG. 5 shows a graph in which the mercury vapor pressure is plotted as a function of the temperature for an amalgam in accordance with a second aspect of the invention, comprising different lead and mercury contents.

FIG. 5 shows a graph in which the mercury vapor pressure $P_{Hg}$ is plotted as a function of the temperature for an amalgam in accordance with a second aspect of the invention, with a different lead and mercury content, namely Bi45—Sn53—Pb2—Hg0.1 (curve D) and Bi44—Sn52—Pb4—Hg0.2 (curve E). The two horizontal dot-and-dash lines show the range within which the radiation output is at least 80% of that during optimal operation. FIG. 5 shows how the mercury vapor pressure curves can be optimized with the lead and mercury content. Amalgams in accordance with a second aspect of the invention are notably suitable for use in electrodeless low-pressure mercury vapor discharge lamps. For electrodeless low-pressure mercury vapor discharge lamps which consume a comparatively small quantity of mercury during their lifetime, a more optimal amalgam can be designed with a comparatively low initial mercury content, which is favorable for a high radiation output within a comparatively large range of ambient temperatures during the lifetime of the discharge lamp.

It will be evident that many variations within the scope of the invention can be conceived by those skilled in the art.

The protective scope of the invention is not limited to the embodiments described. The invention resides in each and every novel characteristic feature and each and every combination of characteristic features. Reference numerals in the claims do not limit their protective scope. Use of the word "comprising" does not exclude the presence of elements other than those mentioned in the claims. Use of the word "a" or "an" preceding an element does not exclude the presence of a multitude of such elements.

What is claimed is:

1. A low-pressure mercury vapor discharge lamp provided with a discharge vessel (10), which discharge vessel (10; 210) encloses a discharge space (11; 211) containing a filling of mercury and a rare gas in a gastight manner, which discharge vessel (10; 210) contains an amalgam (63; 263) which is in communication with the discharge space (11), and in which the low-pressure mercury vapor discharge lamp comprises discharge means (41*a*, 41*b*; 234) for maintaining an electric discharge in the discharge vessel (10; 210), characterized in that the amalgam (63; 263) has a bismuth-tin ratio (Bi:Sn) in the range of 20:80≦Bi:Sn≦80:20, a lead content (Pb) in the range of 0.7≦Pb≦12 at % and a mercury content (Hg) in the range of 0.05≦Hg≦2 at %.

2. A low-pressure mercury vapor discharge lamp as claimed in claim 1, characterized in that the bismuth-tin ratio in the amalgam (63) is 20:80≦Bi:Sn≦80:20, the lead content is 0.7≦Pb≦12 at % and the mercury content is 0.2≦Hg≦2 at %.

3. A low-pressure mercury vapor discharge lamp as claimed in claim 2, characterized in that the bismuth-tin ratio in the amalgam (63) is 30:70≦Bi:Sn≦70:30, the lead content is 1≦Pb≦10 at % and the mercury content is 0.25≦Hg≦1.2 at %.

4. A low-pressure mercury vapor discharge lamp as claimed in claim 1, characterized in that the bismuth-tin ratio in the amalgam (263) is 20:80≦Bi:Sn≦80:20, the lead content is 0.7≦Pb≦12 at % and the mercury content is 0.05≦Hg≦0.5 at %.

5. A low-pressure mercury vapor discharge lamp as claimed in claim 4, characterized in that the bismuth-tin ratio in the amalgam (263) is 30:70≦Bi:Sn≦70:30, the lead content is 1≦Pb≦10 at % and the mercury content is 0.05≦Hg≦0.5 at %.

* * * * *